US006123592A

United States Patent [19]

Ozawa

[11] Patent Number: 6,123,592

[45] Date of Patent: Sep. 26, 2000

[54] FUEL INJECTION SYSTEM FOR WATERCRAFT ENGINE

[75] Inventor: Shigeyuki Ozawa, Iwata, Japan

[73] Assignee: Yamaha Hatsudoki Kabushiki Kaisha, Iwata, Japan

[21] Appl. No.: 09/175,482

[22] Filed: Oct. 20, 1998

[30] Foreign Application Priority Data

Oct. 20, 1997 [JP] Japan ..... 9-287270

[51] Int. Cl.[7] ..... B63H 21/38

[52] U.S. Cl. ..... 440/88; 440/42

[58] Field of Search ..... 440/40, 42, 88

[56] References Cited

U.S. PATENT DOCUMENTS 5,184,966 2/1993 Kobayashi et al. ..... 440/42
5,540,174 7/1996 Kishi et al. ..... 114/291
5,951,342 9/1999 Ozawa et al. ..... 440/88

FOREIGN PATENT DOCUMENTS 10-236392 9/1998 Japan .

*Primary Examiner*—Sherman Basinger
*Attorney, Agent, or Firm*—Knobbe, Martens, Olson and Bear LLP

[57] ABSTRACT

A watercraft includes a trim control and a fuel injection system. The fuel injection system is designed so that the discharge portion of the supply line from the low pressure pump to the high pressure pump extends in a generally downward direction regardless of the trim adjusted condition of the watercraft. In a like manner, the fuel rail which has a high pressure inlet at one end and a return line at the other end is disposed so that the return line is disposed vertically above the inlet under all trim adjusted conditions for automatic vapor purging.

16 Claims, 8 Drawing Sheets

FUEL INJECTION SYSTEM FOR WATERCRAFT ENGINE

BACKGROUND OF THE INVENTION

This invention relates to a fuel injection system for a watercraft engine and more particularly to an improved fuel injection system for a personal watercraft.

As is well known, personal watercraft are a very popular type of watercraft and are utilized by many people. A personal watercraft generally is designed so as to be operated by a single rider who may carry one or a few additional passengers. Because of the small nature of these watercraft, at times the trim condition can vary significantly.

In order to provide a greater latitude of control for the watercraft and to accommodate for varying trim conditions, the jet propulsion unit, the type of propulsion unit commonly used in these watercraft, may be provided with a trim adjusting system whereby the trim may be adjusted through changing the angle of the discharge nozzle of the jet propulsion unit about a horizontal axis or in some other manner. This permits the rider more control over the watercraft trim condition especially during planing.

It has been proposed recently to employ fuel injection systems for personal watercraft. Fuel injection systems offer the opportunity of increased fuel economy and exhaust emission control as well as better overall engine performance. These systems employ generally a low pressure pump that delivers fuel to a high pressure pump which, in turn, then delivers the fuel to the fuel injectors of the engine. Normally, the fuel is supplied through a fuel rail and a pressure regulator is positioned in the fuel rail. The pressure regulator regulates the fuel pressure by dumping excess fuel back to the fuel tank or some other place upstream of the high pressure pump.

However, when the trim condition of a watercraft is changed, then the angular relationship of the fuel lines and the fuel rail can change. When this happens, then the pressure differences against which the pumps may act can vary and this can result in erratic or unstable engine operation.

It is, therefore, a principal object of this invention to provide an improved fuel supply system for a personal watercraft.

It is another object of this invention to provide an improved fuel supply system for a personal watercraft having a trim adjustment and wherein adjustment of the trim has a minimal effect on the injection system when adjustments are made.

With the fuel supply system and particularly the fuel rail, it is desirable to have the fuel rail disposed so that it extends at an angle to the horizontal so that the inlet side of the fuel supply system and the return are always in a condition wherein the slope is in an upward direction. That is, it is desirable to provide an arrangement wherein the fuel rail is disposed so that the pressure regulator is disposed at a higher level than the inlet side to the fuel rail. This condition should be maintained regardless of the trim adjustment.

In connection with the fuel system, it is also desirable to maintain the arrangement so that any fuel vapors which may be entrapped in the system can easily flow back on the return path. Thus, it is important to ensure that the fuel rail is always inclined in a generally upward direction from its inlet end to the outlet end that communicates back with the fuel tank. This will help to ensure that vapors will be purged and will not enter the fuel injectors and cause improper injection.

It is, therefore, a still further object of this invention to provide a fuel rail arrangement for a watercraft and trim system therefor wherein that regardless of the trim angle during normal planing operation, the air will be purged from the fuel rail because the fuel rail is disposed so that it is always inclined upwardly from its supply end to its return end.

SUMMARY OF THE INVENTION

The features of this invention are adapted to be embodied in a small watercraft having an internal combustion engine and a propulsion device driven by the engine for propelling the watercraft. The engine includes a fuel injection system having a fuel supply system for delivering fuel to a high pressure pump and a fuel rail that delivers fuel to the fuel injectors for injection into the engine. The fuel supply system also includes a return conduit for return of fuel from the fuel rail to the fuel tank for maintaining the desired pressure in the fuel rail. The watercraft is provided with a trim system wherein the trim during planing conditions can be adjusted.

In accordance with a first feature of the invention, a major portion of the fuel supply line to the high pressure pump is disposed so that it extends in a downward direction to the high pressure pump regardless of the trim angle of the watercraft during planing.

In accordance with another feature of the invention, the fuel rail is disposed so that the return line is above the pressure inlet line under all trim adjusted conditions during planing so that air can be purged from the system.

DETAILED DESCRIPTION OF THE PREFERRED EMBODIMENTS OF THE INVENTION

Figure 1:
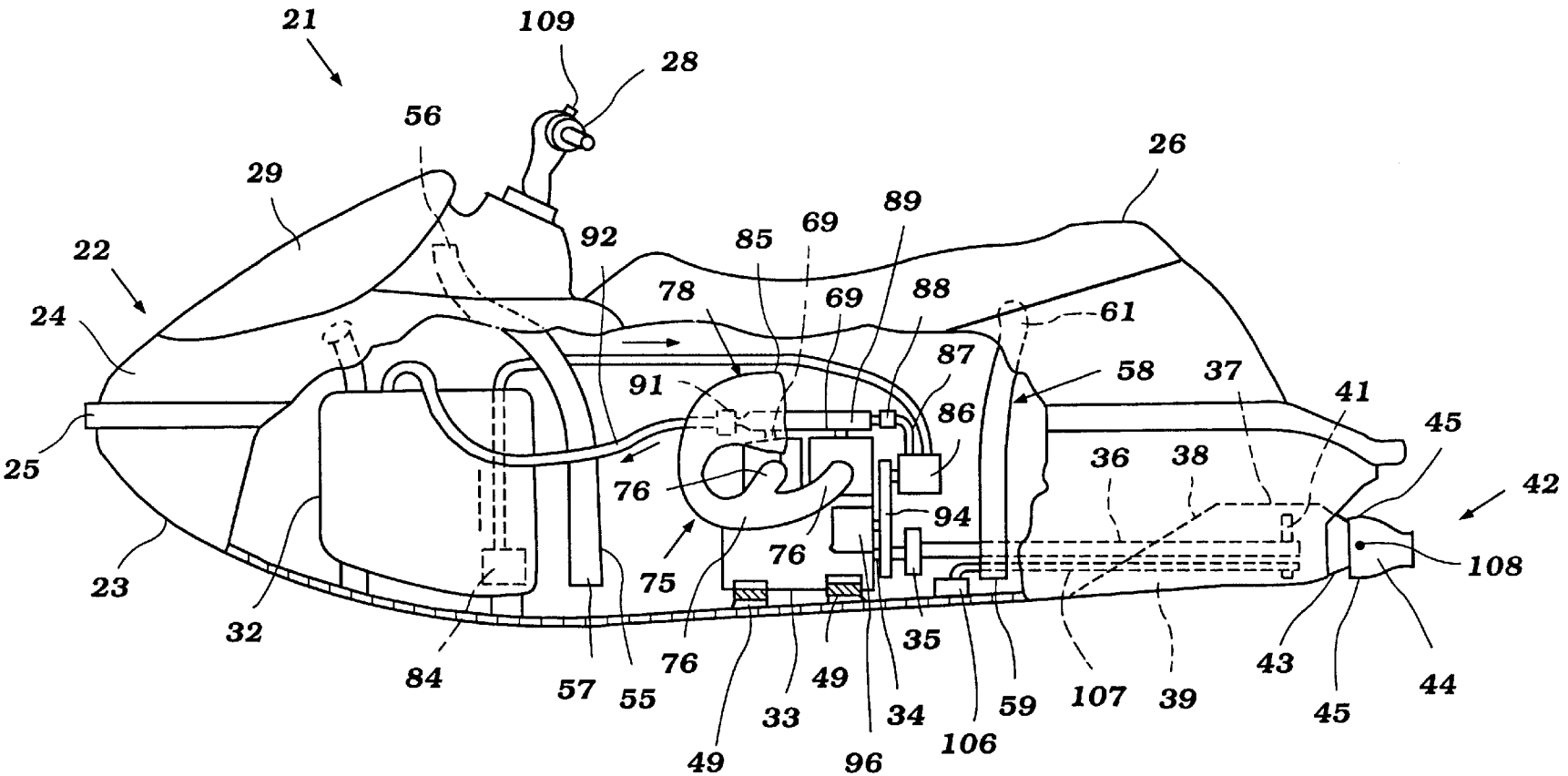
FIG. 1 is a side elevational view of a small watercraft constructed in accordance with a first embodiment of the invention, with a portion broken away so as to show the engine and the fuel supply system for it in solid lines.
Figure 2:
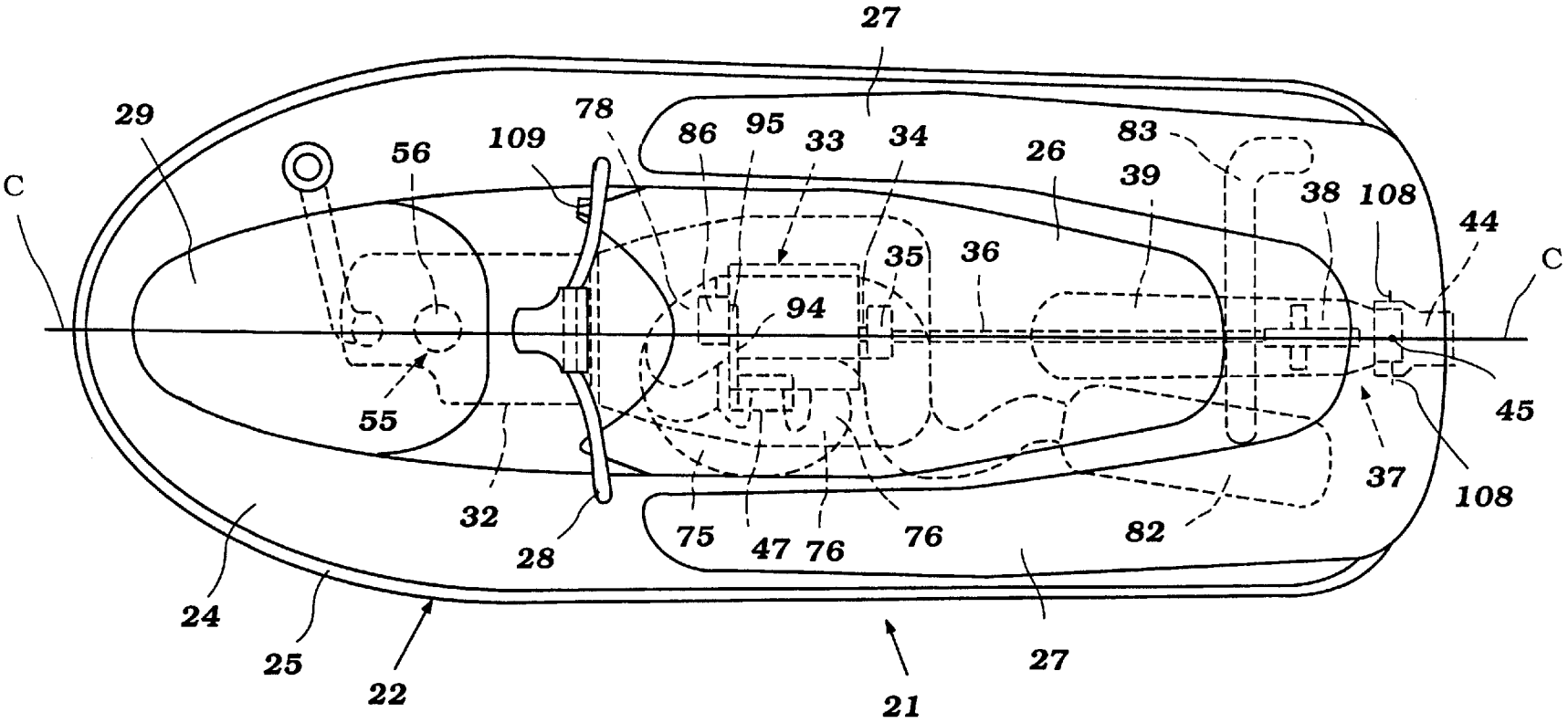
FIG. 2 is a top plan view of the watercraft.

Referring now in detail to the drawings and initially to FIGS. 1 and 2, a small personal watercraft constructed in accordance with a first embodiment of the invention is indicated generally by the reference numeral 21. The watercraft 21 is of a type referred to as a "personal watercraft" and this is a small type of watercraft that is designed primarily for operation by a single rider and may carry a few additional passengers. The invention has particular utility in connection with that type of watercraft because they are likely to have the trim effected by the number of passengers and placement of them in the seating area. It is to be understood that this specific watercraft described is typical of many with which the invention may be practiced.

The watercraft 21 has a hull assembly, indicated generally by the reference numeral 22, which consists of a lower, hull portion 23 and an upper, deck portion 24. The hull and deck portions 23 and 24 are formed from a suitable material such as a molded fiberglass reinforced resinous plastic or the like. They are secured together around their periphery, as by means of a gunnel 25 in any suitable manner.

To the rear of the watercraft hull 22 there is provided a rider's area that consists of a raised seat portion 26 upon which the rider, operator and his passengers may sit in straddle tandem fashion. The deck portion 24 is provided with a pair of side foot areas 27 on opposite sides of the seat 26 on which the seated riders may place their feet.

Positioned forwardly of the seat 26 is a mast 28 which operates to provide steering for the watercraft 21 in a manner which will be described. This mast 28 is positioned forwardly of a forward hatchcover 29 which can be opened selectively for an access to the a storage compartment and through it the interior of the watercraft.

The hull and deck portions 23 and 24 define an engine compartment 31. A fuel tank 32 is positioned at the forward end of this engine compartment 31 for supplying fuel to an internal combustion engine, indicated generally by the reference numeral 33. The fuel tank 32 can be accessed through the hatch cover 29.

The engine 33 has an output shaft 34 which is connected by means of a flexible coupling 35 to the impeller shaft 36 of a jet propulsion unit, indicated generally by the reference numeral 37. This jet propulsion unit 37 is positioned on the hull underside at the rear of the rider's area and beneath, at least in part, the rearward-most portion of the seat 26.

The jet propulsion unit 37 may be of any known type and includes an outer housing 38 that defines a downwardly facing water inlet opening portion 39 which opens through the lower face of the hull portion 23. Water is drawn through this opening 39 by an impeller 41 that is connected to the impeller shaft 36 and driven by the engine 33 for this purpose. This water is then discharged through a discharge nozzle assembly, indicated generally by the reference numeral 42, for generating a propulsive force to the watercraft. This discharge nozzle assembly 42 includes a fixed nozzle part 43 and an adjustable nozzle part 44.

This adjustable nozzle part 44 is supported for steering movement about a vertically extending steering axis and means of a pair of pivot pins 45. These pivot pins 45 permit movement to the right or left under the control of the steering mast 28 for controlling the direction of travel of the watercraft 21, in a manner well-known in the art.

The general construction of the engine 33 will now be described by additional reference to FIG. 3. In the illustrated embodiment, the engine 33 is depicted as being of the two-cycle, crankcase compression type. The engine 33 in the illustrated embodiment is depicted as being a two cycle, two cylinder, inline engine and is mounted so that its crankshaft, the aforenoted referred to engine output shaft 35, rotates about a longitudinally extending axis which lies on a vertical plane V and which is also disposed on a longitudinally extending center plane C of the watercraft 21. Although such an engine is illustrated, it will be readily apparent to those skilled in the art how the invention can be employed with engines of other types.

The engine 33 has a cylinder block 46 that has a pair of cylinder bores 47 which have their axes A lying on a common longitudinally extending plane. As seen in FIG. 3, however, this plane is disposed at an acute angle to: the vertical plane V and also to the longitudinal plane C of the watercraft. This is done so as to facilitate the positioning of the various components, as will be described, as well as to permit a relatively low center of gravity.

The cylinder block 46 is connected to a crankcase member 47 which is mounted on the hull portion 23 by elastic isolators 48. The crankshaft 35 is rotatably journaled within a crankcase chamber that is formed by the crankcase member 47. In accordance with the conventional two-cycle practice, the crankcase chamber associated with each cylinder bore 47 is sealed from the others. The reason for this will become apparent shortly.

Pistons 51 reciprocate in each of the cylinder bores 47. The pistons 51 are connected to the upper or small ends of respective connecting rods 52. The lower ends of the connecting rods 52 are journaled on the throws of the crankshaft 35 in any well known manner.

An induction system, indicated generally by the reference numeral 53 is provided for delivering an air charge to the aforenoted sealed crankcase chambers formed below each cylinder bore 47. This induction system includes an air inlet device 54 that draws atmospheric air from within the engine compartment 31. This air is introduced by a ventilating system including a main inlet ventilating tube 55 (FIGS. 1 and 2) that has an inlet opening 56 that is disposed beneath the hatch cover 29 and a discharge opening 57 that terminates in the engine compartment 31.

Excess ventilating gases can be discharged through a discharge pipe 58 positioned rearwardly in the hull and having an inlet opening 59 formed in the rearward portion of the engine compartment 31. A discharge opening 61 of this ventilating discharge pipe 58 extends under the seat 26 for discharge of the excess ventilating gases back to the atmosphere.

Figure 3:
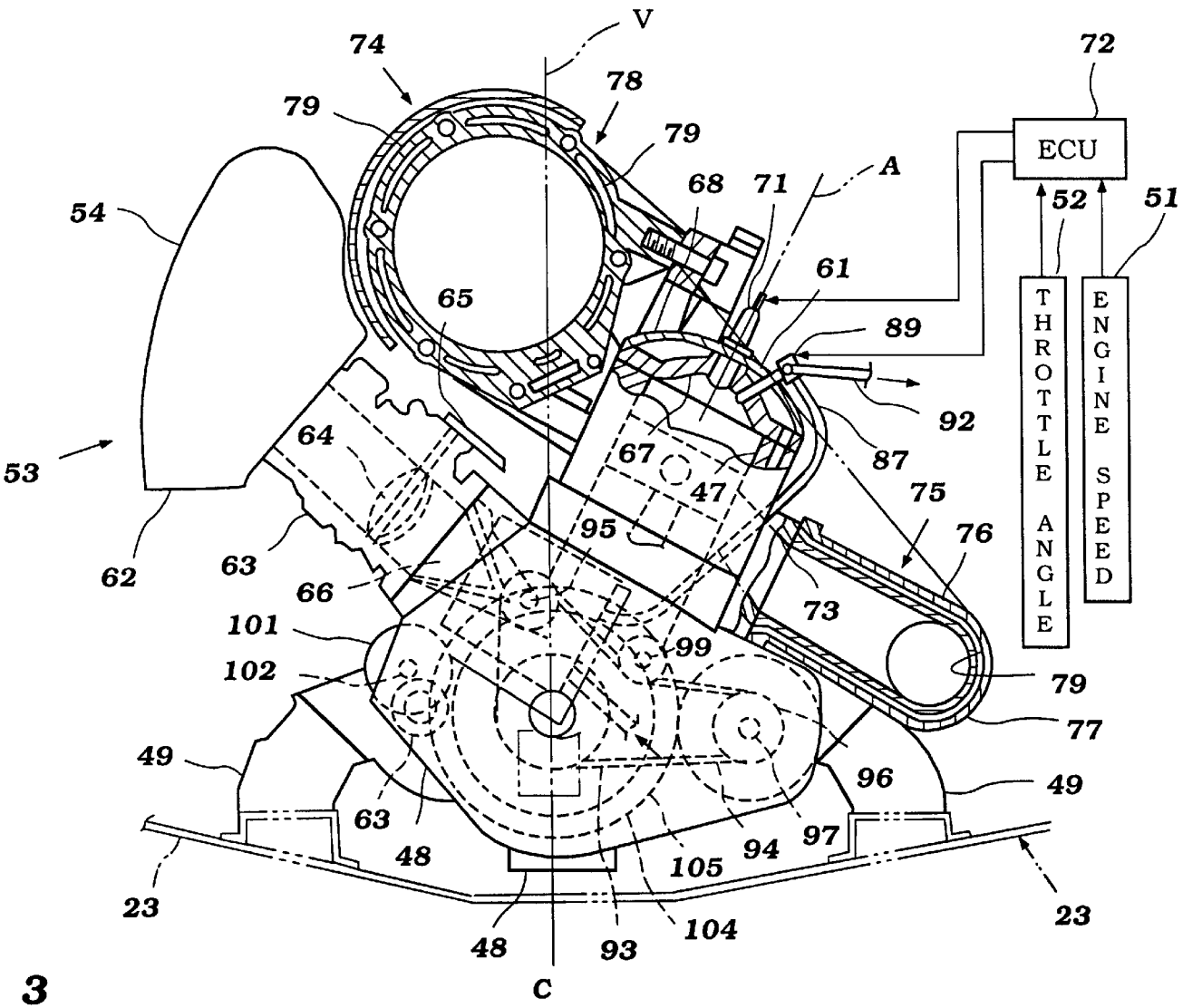
FIG. 3 is an enlarged front view looking in a longitudinal direction along the watercraft showing the engine in solid lines, with portions broken away and shown in section, the engine control schematically and the supporting watercraft hull in phantom.

Returning now primarily to the description of the engine and principally to FIG. 3, the inlet device 54 of the engine inlet induction system 53 has a generally downwardly facing inlet opening 62 through which the air is drawn. This air is then delivered to a pair of throttle bodies 63, each of which has a throttle valve 64 positioned in it. The throttle valves 64 are journaled on throttle valve shafts having a throttle actuating linkage 55 at their outer ends for controlling the speed of the engine.

The throttle bodies 35 deliver the air to the crankcase chambers through intake ports 66 in which reed-type check valves are positioned so that when the piston 51 move upwardly in the cylinder bores 47, an air charge will be drawn into the aforenoted crankcase chamber. As the pistons move downwardly, this charge will be compressed and the check valve 66 will close so as to preclude reverse flow.

The charge is then transferred to combustion chambers formed above the heads of the pistons 51 by the pistons and by recesses 67 formed in a cylinder head assembly 68 that is detachably connected to the cylinder block 46 in a known manner. This transfer of charge to the combustion chambers takes place through a suitable scavenging system.

Fuel is then injected into the combustion chambers at an appropriate time by fuel injectors 69 that are mounted in the cylinder head assembly 68. Fuel is supplied to the fuel injector 69 by a fuel supply system which will be described shortly.

The charge which is thus formed in the combustion chambers is then ignited by a spark plug 71 mounted in the cylinder head assembly 68 for each cylinder bore 47. This spark plug 71 is fired under the control of an ECU 72 which also controls the operation of the fuel injector 69 so as to control the timing and duration of fuel injection. The main control strategy for achieving this result may be of any known type although certain facets of the control may be of any known type. The control employs a number of sensors that sense various conditions. As examples, engine speed and throttle angle sensors, S1 and S2 are shown schematically.

The charge which bums in the combustion chambers will expand to drive the pistons 51 downwardly. Eventually, this downward movement will open exhaust ports 73 formed in the cylinder block 46 and which communicates with an exhaust system, indicated generally by the reference numeral 74. This exhaust system includes an exhaust manifold 75 which is affixed to the side of the cylinder block 46 in mating relationship with the exhaust port 73. This exhaust manifold 75 has a double-wall construction consisting of an outer pipe 76 and an inner pipe 77 which define a water jacket therebetween. Cooling water is circulated through this water jacket for cooling the exhaust manifold.

The exhaust manifold extends downwardly and then curves at one end of the engine 33 and passes upwardly to deliver the exhaust gases to an expansion chamber device 78 that extends longitudinally along the upper side of the engine 33. This device 78 also has a water jacket that communicates with the exhaust manifold water jacket, these water jackets being indicated by the reference numeral 79.

As best seen in FIG. 2, the expansion chamber device 78 terminates at the rear end of the engine 33. At this point, an exhaust pipe 81 receives the exhaust gases and delivers them rearwardly to a water trap device 82 that is positioned on one side of a tunnel in the hull in which the jet propulsion unit 37 is positioned. This water trap device 82 functions, in a manner as well known in the art, to preclude water from being able to enter the engine through the exhaust system.

An exhaust discharge pipe 83 extends from this water trap device 82 to an opening in the hull 22 through which the exhaust gases are discharged. This opening is preferably located on the other side of the jet propulsion unit 37 and may be either above or below the water under normal running conditions.

The fuel supply system for the fuel injectors 69 will now be described continuing by primary reference to FIGS. 1–3. Certain aspects of the fuel supply system which deal with the invention will be described later by reference to FIGS. 4–9.

The fuel supply system includes a low pressure pump 84 that is submerged in a lower area of the fuel tank 32 and which is at the inlet end of a fuel supply conduit 85. This conduit 85 extends rearwardly in the engine compartment 31 to a high pressure, mechanical fuel pump 86 that is driven from the engine in a manner which will be described shortly. The high-pressure pump 86 delivers fuel through a conduit 87 in which a fuel filter 88 is positioned to a fuel rail 89. The fuel rail 89 is connected to the individual injector 69 for delivering fuel thereto in a manner which is well known in this art. It should be noted that this fuel rail 89 is inclined upwardly in a forward direction.

At the opposite or forward end of the fuel rail 89, there is positioned a pressure regulator 91. The pressure regulator 91 functions as to as to maintain a predetermined pressure in the fuel rail 89 so as to permit more accurate fuel injection control. The pressure regulator 91 regulates this pressure by dumping excess fuel back to the fuel tank 32 through a return line 92.

The drive for the high-pressure fuel pump 86 will now be described again by reference primarily to these same three FIGS. (1–3). The crankshaft 35 and particularly the portion of it exposed toward the rear of the engine and forwardly of the drive coupling 35 has affixed to it a drive pulley 93. This drive pulley 93 drives a drive belt 94. The drive belt 94 is entrained around a driving pulley 95 of the high pressure pump 86.

The drive belt 94 also drives a drive pulley 96 affixed to an alternator shaft 97. The alternator shaft 97 is associated with an electrical alternator 98 for generating electrical power for the engine and specifically for operating the ECU 72, the spark plugs 71 and the solenoids of the fuel injectors 69. An idler pulley 99 cooperates with the belt 94 so as to maintain the appropriate tension on it.

The engine 33 may also be provided with an electrical starter, indicated generally by the reference numeral 101. The starter 101 has a pinion gear 102 that is enmeshed through a gear train including a gear 103 that meshes with a ring gear 104 that is affixed to a flywheel 105 of the engine crankshaft 35 in a known manner.

It has been noted that the engine exhaust system has a cooling jacket and the engine itself is also provided with a cooling jacket. Cooling water is circulated through this cooling jacket by tapping off a source of water from the jet propulsion unit 37 in a manner that is generally known in this art.

The jet propulsion unit 37 also may be utilized as a bilge pump. To this end, there is provided a water pickup device 106 that is provided in the lower end of the engine compartment 31. A conduit 107 extends from this pickup device back to the jet propulsion unit at a point to the rear of the impeller 41. The water flow through the discharge nozzle 43 will generate a negative pressure that will cause any water that may accumulate in the bilge to be drawn through the inlet 106 and discharge back to the body of water in which the watercraft is operating through the jet propulsion unit discharge nozzle 43. The watercraft 21 is also provided with a trim adjusting system. To this end, the moveable discharge nozzle 44 in addition to being pivotal for steering movement about the vertically extending axis defined by the pivot pins 45 is pivotal about a horizontally extending axis to accomplish a trim adjustment. The pivot pins for this purpose are indicated in FIGS. 1 and 2 by the reference numerals 108. In order to control the trim position, a suitable servomotor is provided. This is adjusted by means of a trim adjust switch 109 carried on the steering mass 28 at one side thereof.

The arrangement of the fuel supply line 85 and the fuel rail 89 is such that the discharge portion of the fuel supply line 85 always is inclined downwardly from the low pressure pump 84 to the high pressure pump 86 regardless of the trim adjusted angle. This will permit the use of a smaller, lower capacity low pressure pump 84.

In addition, the main fuel rail 89 is always inclined upwardly in a forward direction regardless of the trim condition from the inlet end where the filter 88 and high pressure pump 86 is positioned to the pressure relief valve 91. Thus, the return flow, shown by the broken lines in these figures is always uphill. This will permit any air or fuel vapors that are trapped in the system to flow forwardly to return to the tank 32 and not create problems with fuel injection.

Figure 4:
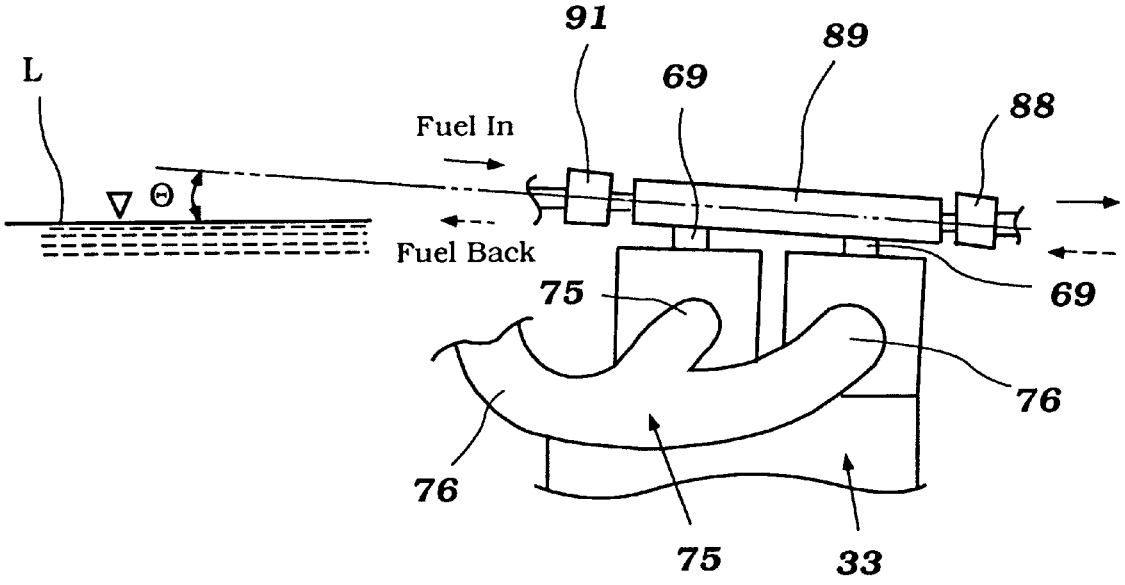
FIG. 4 is a partial, side elevational view showing the orientation of the fuel supply system for the engine relative to the water level in a first trim condition.
Figure 5:
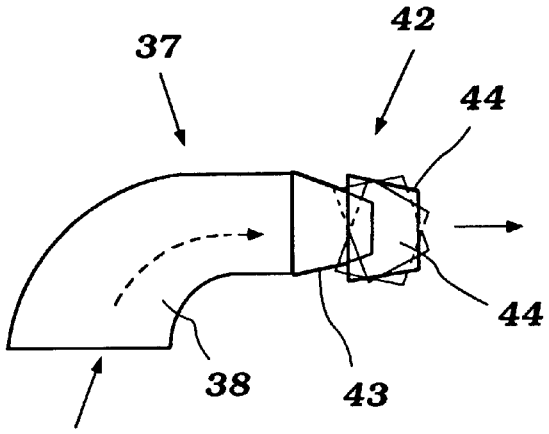
FIG. 5 is a schematic view of the jet propulsion unit looking in the same direction as FIG. 4 and shows how the trim can be adjusted with the trim adjusting nozzle.
Figure 6:
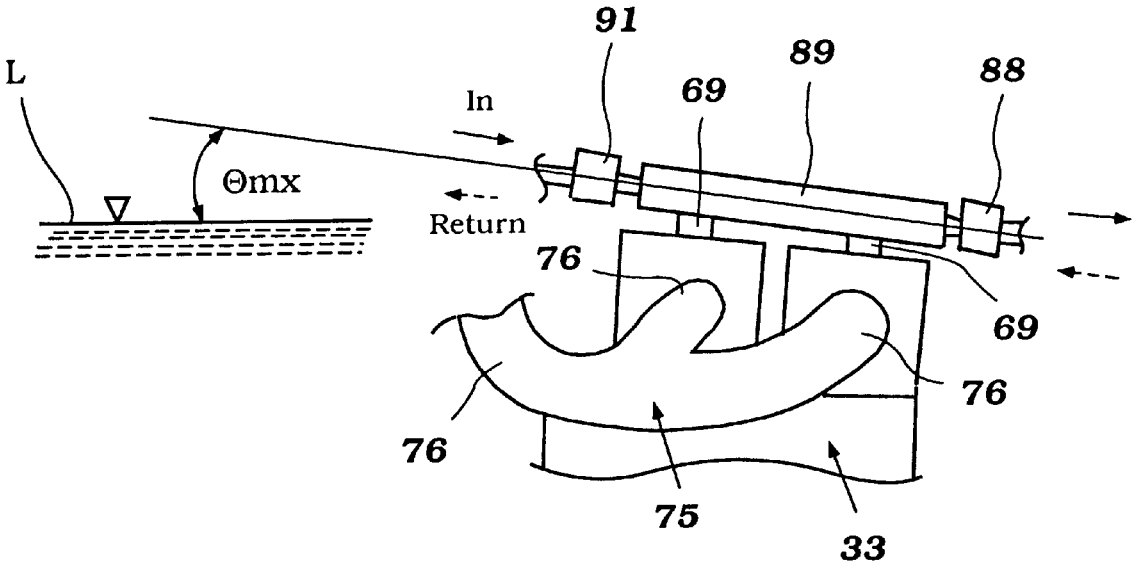
FIG. 6 is a side elevational view, in part similar to FIG. 4 and shows the condition of the fuel system relative to the water level in another trim condition.
Figure 7:
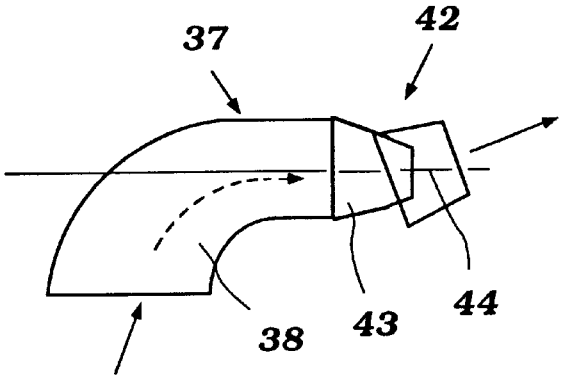
FIG. 7 is a view in part similar to FIG. 5 and shows the trim adjusting nozzle position in this trim condition.
Figure 8:
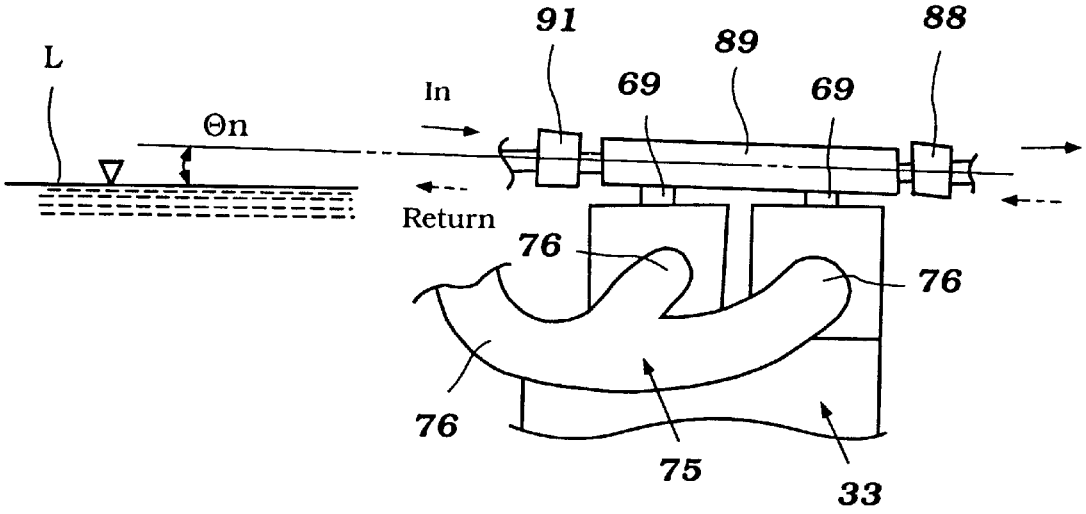
FIG. 8 is a view in part similar to FIGS. 4 and 6 and shows the fuel orientation relative to the water level in another trim condition.
Figure 9:
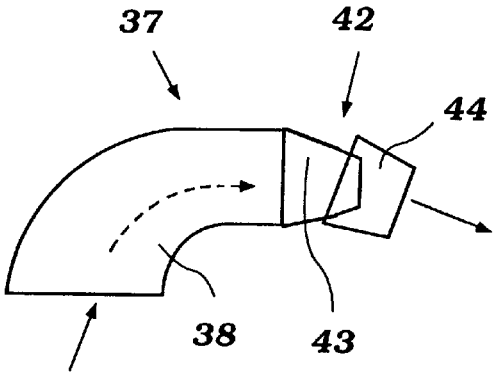
FIG. 9 is a view in part similar to FIGS. 5 and 7 and shows the orientation of the trim nozzle in this condition.

FIGS. 4 and 5 show how the trim angle θ at planing is related to the fuel rail 89 and the supply line 85 as shown by the solid lines relative to the water level, indicated at L. Thus, when the trim angle is adjusted by moving the discharge nozzle 44 through the range shown in FIG. 5, these two lines will always be in the proper orientation so that the low pressure pump need not exert high pressures and also so that the fuel rail is always disposed so that air will be purged from it. This is true from the range of maximum trim condition as shown in FIGS. 6 and 7 and minimum trim condition as shown in FIGS. 8 and 9. These are, of course, the trim conditions during normal planing operations.

Figure 10:
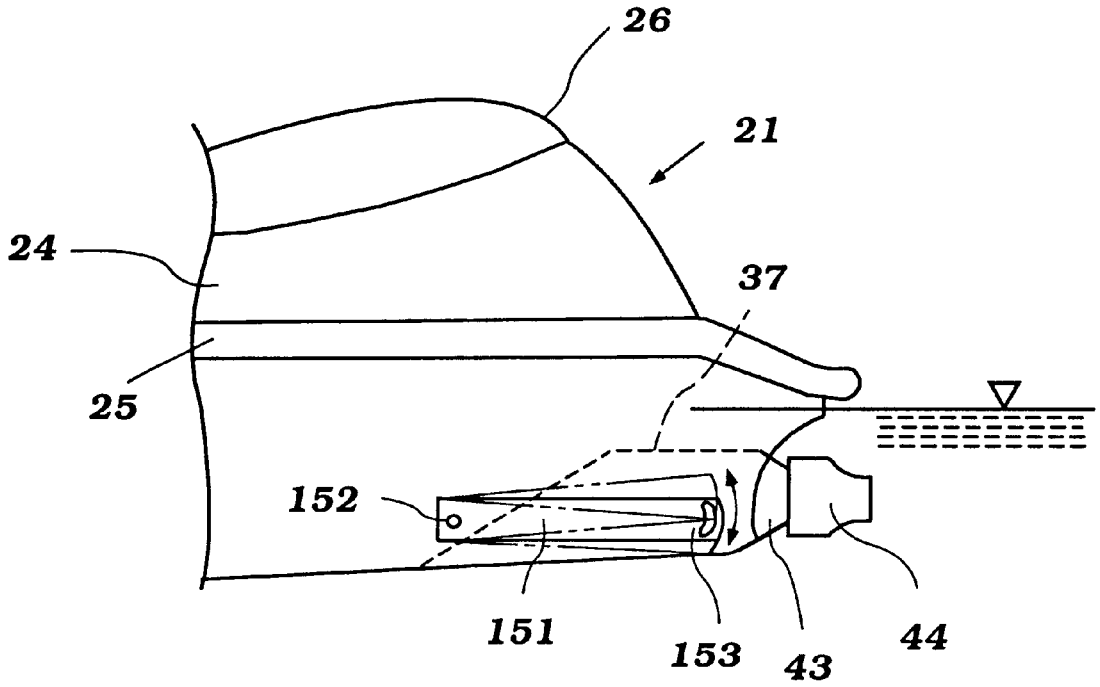
FIG. 10 is a partial side elevational view showing another mechanism for adjusting the trim condition.
Figure 11:
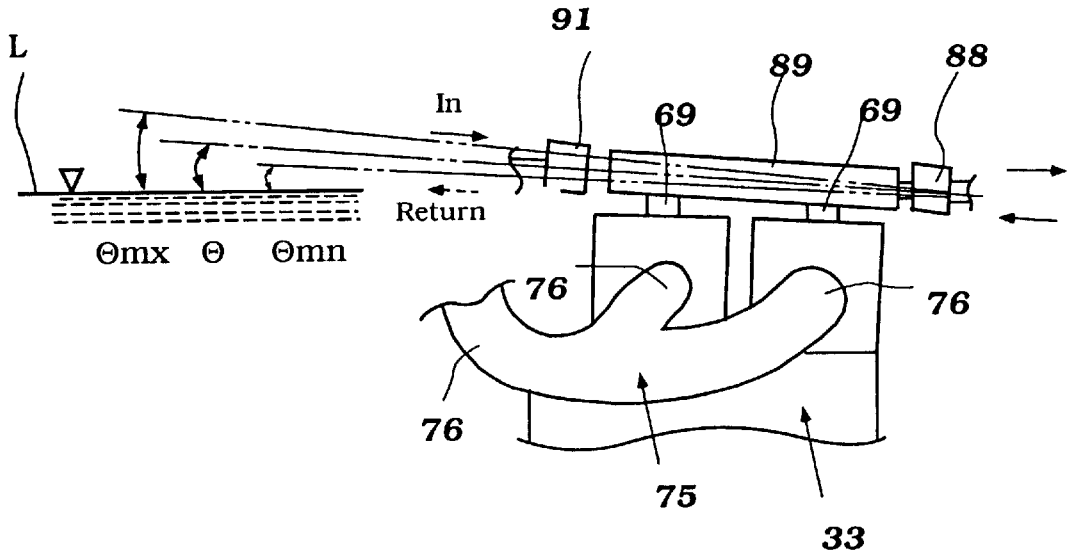
FIG. 11 is a multi-part view, in part similar to FIGS. 4, 6 and 8, showing varying trim conditions of the fuel system in connection with this embodiment.
Figure 12:
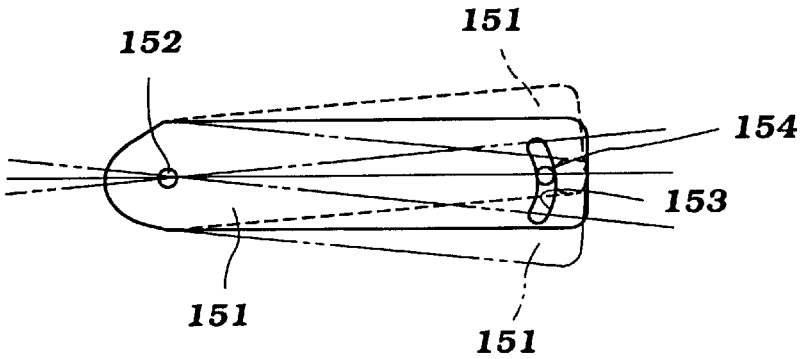
FIG. 12 is a view in part similar to FIGS. 5, 7, and 9, and shows the position of the trim adjusting mechanism in the conditions shown in FIG. 11.

In the embodiment as thus far described, the trim adjustment is made by adjusting only the discharge nozzle 44. FIGS. 10–12 show another arrangement wherein the entire jet propulsion unit is pivoted to achieve trim adjustment. In this embodiment, therefore, there is provided an adjusting lever, indicated generally by the reference numeral 151 that is pivotally mounted on the watercraft hull 22 about a pivot axis 152. This lever 151 may be swung through a range of trim adjustment by moving it with a control such as the control 109 that operates a servomotor so as to effect this pivotal movement.

The trailing end of the trim lever 151 is provided with a slot 153 in which a pin 154 fixed to the jet propulsion unit outer housing 36 is received. The jet propulsion unit outer housing is also supported for pivotal movement about an axis. Thus, by adjusting the lever 151 about the pivot point 152 the jet propulsion unit may be swung between raised and lowered positions to achieve trim adjustment of the watercraft.

FIGS. 11 and 12 show that regardless of the adjusted positions within the range of planing, the aforenoted conditions are maintained. That is, the discharge portion of the fuel supply line 85 from the low pressure pump 84 to the high pressure pump 86 is always downhill so as to minimize the amount of pressure that the pump must generate.

The fuel rail 89, on the other hand is always inclined upwardly from its inlet end to its return end so that air can be purged from the system.

Thus, it should be readily apparent from the foregoing description that the described embodiments of the invention to provide a fuel injection system for a watercraft having a trim control wherein trim adjustment within the permitted range will not adversely effect the injection system. Of course, the foregoing description is that of preferred embodiments of the invention. Various changes and modifications may be made without departing from the spirit and scope of the invention, as defined by the appended claims.

What is claimed is:

1. A small watercraft having an internal combustion engine and a propulsion device driven by said engine for propelling the watercraft said engine including a fuel injection system having a plurality of fuel injectors and a fuel supply system for delivering fuel to a high pressure pump and a fuel rail that delivers fuel to said fuel injectors for injection into said engine, said fuel supply system including a fuel supply pump and a fuel supply line extending from the fuel supply pump to the high pressure pump, said watercraft having a trim system wherein the trim at least during planing conditions can be adjusted, a major portion of said fuel supply line extending to said high pressure pump being disposed so that it extends in a downward direction to said high pressure pump regardless of the trim angle of said watercraft during planing.

2. The small watercraft as set forth in claim 1 wherein the propulsion device comprises a jet pump.

3. The small watercraft as set forth in claim 2 wherein the jet pump is adjustable for effecting the trim condition.

4. The small watercraft as set forth in claim 3 wherein the jet pump discharge nozzle is adjustable to effect the trim condition.

5. The small watercraft as set forth in claim 1 wherein the major portion of the fuel supply line extends longitudinally of the watercraft.

6. The small watercraft as set forth in claim 1 further including a return conduit for return of fuel from the fuel rail to the fuel tank for maintaining the desired pressure in said fuel rail and wherein said fuel rail is disposed so that said return conduit is above an inlet of the fuel rail under all trim adjusted conditions during planing so that air can be purged from the system.

7. The small watercraft as set forth in claim 6 wherein the propulsion device comprises a jet pump.

8. The small watercraft as set forth in claim 7 wherein the jet pump is adjustable for effecting the trim condition.

9. The small watercraft as set forth in claim 8 wherein the jet pump discharge nozzle is adjustable to effect the trim condition.

10. The small watercraft as set forth in claim 6 wherein the major portion of the fuel supply line and the fuel rail extend longitudinally of the watercraft.

11. A small watercraft having an internal combustion engine and a propulsion device driven by said engine for propelling the watercraft said engine including a fuel injection system having a plurality of fuel injectors and a fuel supply system for delivering fuel to a high pressure pump and a fuel rail that includes an inlet and that delivers fuel to said fuel injectors for injection into said engine, said fuel supply system including a return conduit for return of fuel from said fuel rail to said fuel tank for maintaining the desired pressure in said fuel rail, said return conduit having an inlet communicating with said fuel rail, the return conduit extending from the fuel rail, said watercraft having a trim system wherein the trim at least during planing conditions can be adjusted, said fuel rail being disposed so that said return conduit inlet is above an inlet of said fuel rail under all trim adjusted conditions during planing so that air can be purged from the system.

12. The small watercraft as set forth in claim 11 wherein the propulsion device comprises a jet pump.

13. The small watercraft as set forth in claim 12 wherein the jet pump is adjustable for effecting the trim condition.

14. The small watercraft as set forth in claim 13 wherein the jet pump discharge nozzle is adjustable to effect the trim condition.

15. The small watercraft as set forth in claim 11 wherein the major portion of the fuel rail extends longitudinally of the watercraft.

16. A small watercraft having an internal combustion engine and a propulsion device driven by said engine for propelling the watercraft, said engine including a fuel injection system having a plurality of fuel injectors and a fuel supply system for delivering fuel to a high pressure pump and a fuel rail that delivers fuel to said fuel injectors for injection into said engine, said fuel rail including first and second ends, said watercraft having a trim system wherein the trim at least during planing conditions can be adjusted, said fuel rail being disposed so that said second end is above said first end under all trim adjusted conditions during planing so that air can be purged from the system.

* * * * *